United States Patent [19]

Malagari, Jr. et al.

[11] 4,157,925

[45] Jun. 12, 1979

[54] TEXTURE ANNEALING SILICON STEEL

[75] Inventors: Frank A. Malagari, Jr., Freeport; Robert F. Miller, New Kensington; Jack W. Shilling, Monroeville; James H. Wells, Natrona Heights, all of Pa.

[73] Assignee: Allegheny Ludlum Industries, Inc., Pittsburgh, Pa.

[21] Appl. No.: 895,678

[22] Filed: Apr. 12, 1978

[51] Int. Cl.[2] ..... H01F 1/04

[52] U.S. Cl. ..... 148/111; 148/31.55; 148/31.5; 148/113

[58] Field of Search ..... 148/111, 112, 113, 31.55; 427/127

[56] References Cited

U.S. PATENT DOCUMENTS

| | | | |
|---|---|---|---|
| 3,873,381 | 3/1975 | Jackson | 148/112 |
| 3,932,234 | 1/1976 | Imanaka et al. | 148/112 |
| 4,054,471 | 10/1977 | Datta | 148/112 |

OTHER PUBLICATIONS

"Development of a New Grain Oriented Silicon Steel RG–H with High Permeability", Goto et al., EPS Conference, Soft Magnetic Materials 2, Cardiff, U.K., Apr., 1975.

*Primary Examiner*—L. Dewayne Rutledge
*Assistant Examiner*—John P. Sheehan
*Attorney, Agent, or Firm*—Vincent G. Gioia; Robert F. Dropkin

[57] ABSTRACT

A process for producing electromagnetic silicon steel having a cube-on-edge orientation. The process includes the steps of: preparing a melt of silicon steel containing from 0.02 to 0.06% carbon, from 0.015 to 0.15% manganese, from 0.005 to 0.05% of material from the group consisting of sulfur and selenium, from 0.0006 to 0.0080% boron, up to 0.0100% nitrogen, up to 1.0% copper, less than 0.005% antimony, less than 0.009% aluminum and from 2.5 to 4.0% silicon; casting; hot rolling; cold rolling; decarburizing; applying a refractory oxide base coating; and final texture annealing. During final texture annealing the steel is heated from a temperature of 1700° F. to a temperature of 1900° F. at an average rate of less than 30° F. per hour, and subsequently maintained at a temperature in excess of 2000° F. for a period of time sufficient to effect a purification of the steel.

10 Claims, No Drawings

TEXTURE ANNEALING SILICON STEEL

The present invention relates to an improvement in the manufacture of grain-oriented silicon steel.

The development of a cube-on-edge orientation in boron-inhibited electromagnetic silicon steel is dependent upon the phenomenon of secondary recrystallization. Secondary cube-on-edge oriented grains grow at the expense of primary grains when the normal growth of the primary grains is inhibited. Inhibitors such as boron, sulfur and nitrogen restrain normal primary grain growth up to temperatures at which cube-on-edge oriented grains grow and consume the primary grains. This occurs during an operation known as the final texture anneal.

Conventional final texture annealing involves a reasonably continuous heating at a rate of approximately 50° F. per hour to a temperature at which purification occurs, and a relatively long soak time at the purification temperature to remove impurities. The onset of secondary recrystallization occurs during the heating cycle in the range of from 1650° to 1900° F. At temperatures of around 1900° F. the heating rate can, depending on equipment, drop to a value of about 35° F. per hour. Purification occurs at temperatures of from about 2000° to 2300° F.

Through this invention there is provided a heating cycle which has been found to improve the magnetic properties of electromagnetic silicon steel. The steel is heated from a temperature of 1700° to 1900° F. at an average rate of less than 30° F. per hour, and subsequently maintained at a temperature in excess of 2000° F. for a period of at least 4 hours. The slower heating rate provides additional time for the selective grain growth process to occur. It may also alter the grain boundary chemistry in an advantageous way by allowing more time for boron, which may be in the refractory oxide coating applied prior to texture annealing, to diffuse from said coating into the steel. As noted hereinabove, boron is an inhibitor which restrains normal primary grain growth.

Various heating cycles for final texture annealing are described in U.S. Pat. Nos. 2,534,141, 3,930,906, 3,932,234 and 3,933,537, and in a paper by I. Goto, I. Matoba, T. Imanaka, T. Gotoh and T. Kan, entitled, "Development Of A New Grain Oriented Silicon Steel 'RG-H' With High Permeability". The paper was presented at the EPS Conference "Soft Magnetic Materials 2", Cardiff, U. K., April 9–11, 1975. Neither the paper nor the patents disclose the present invention. In addition to differences in the manner in which they texture anneal, not one of them particularly pertain to boron-inhibited silicon steel. Of them, U.S. Pat. Nos. 3,930,906, 3,932,234 and 3,933,537, and the cited paper all pertain to antimony-inhibited silicon steel; whereas antimony is not added to the melt which forms the steel of the present invention. Furthermore, U.S. Pat. No. 3,933,537 pertains to an aluminum and antimony-inhibited silicon steel; and as with antimony, aluminum is not added to the melt which forms the steel of the present invention.

Numerous other references disclose boron-inhibited silicon steel. These references include U.S. Pat. Nos. 3,873,381, 3,905,842, 3,905,843, 3,957,546 and 4,030,950, and U.S. application Ser. No. 696,964, filed June 17, 1976. Ser. No. 696,964 additionally discloses a boron-bearing refractory oxide base coating. None of these references do, however, disclose the final texture anneal of the present invention.

It is accordingly an object of the present invention to provide an improvement in the manufacture of grain-oriented silicon steel.

In accordance with the present invention a melt of silicon steel containing, by weight, from 0.02 to 0.06% carbon, from 0.015 to 0.15% manganese, from 0.005 to 0.05% of material from the group consisting of sulfur and selenium, from 0.0006 to 0.0080% boron, up to 0.0100% nitrogen, up to 1.0% copper, less than 0.005% antimony, less than 0.009% aluminum and from 2.5 to 4.0% silicon is subjected to the conventional steps of casting, hot rolling, one or more cold rollings, an intermediate normalize when two or more cold rollings are employed, decarburizing, application of a refractory oxide coating and final texture annealing at a maximum temperature of 2300° F.; and to an improved heating cycle for final texture annealing. The steel is heated from a temperature of 1700° F. to a temperature of 1900° F. at an average rate of less than 30° F. per hour, and subsequently maintained at a temperature in excess of 2000° F. for a period of time sufficient to effect a purification of the steel. Residuals such as sulfur, carbon and nitrogen are removed during purification. The heating rate from 1700° to 1900° F. is perferably no greater than 25° F. per hour. The average heating rate of the present invention can be achieved by means of an isothermal anneal in said temperature range of from 1700° to 1900° F. Such an anneal i.e., the isothermal anneal, would generally last at least 6 hours. Anneals of at least 10 hours are preferable. The purification period is at least 4 hours and preferably at least 12 hours. It generally exceeds 20 hours. Purification is accomplished in a hydrogen-bearing atmosphere.

Specific processing as to the conventional steps is not critical and can be in accordance with that specified in heretofore referred to U.S. Pat. Nos. 3,873,381, 3,905,842, 3,905,843, 3,957,546 and 4,030,950, as well as heretofore referred to application Ser. No. 696,964. Moreover, the term casting is intended to include continuous casting processes. A hot rolled band heat treatment is also includable within the scope of the present invention. As noted hereinabove, the melt of the present invention is free of deliberate additions of antimony and aluminum. Boron is, however, generally present in the melt at levels of at least 0.0008%. Additional boron may be present in the refractory oxide coating. Steel produced in accordance with the present invention generally has a permeability of at least 1870 ($G/O_e$) at 10 oersteds.

The following examples are illustrative of several aspects of the invention.

EXAMPLE I

A heat of silicon steel was cast and processed into silicon steel having a cube-on-edge orientation. The chemistry of the melt appears hereinbelow in Table I. Neither antimony nor aluminum were added to the melt.

TABLE I.

| Composition (wt. %) | | | | | | | |
|---|---|---|---|---|---|---|---|
| C | Mn | S | B | N | Si | Cu | Fe |
| 0.030 | 0.035 | 0.023 | 0.0012 | 0.0053 | 3.08 | 0.35 | Bal. |

Processing for the steel involved soaking at an elevated temperature for several hours, hot rolling to a nominal gage of 0.080 inch, hot roll band normalizing, cold rolling to a final gage of about 11.5 mils, decarburizing, applying a boron-bearing refractory oxide base coating and final texture annealing as described in the next paragraph.

Four samples of the steel were maintained at a temperature in excess of 2000° F. for a period in excess of 20 hours. Two of the sample (Samples A and B) were heated from 1700° to 1900° F. at a rate of 50° F. per hour. The other two samples (Samples A' and B') were heated through said temperature range at a rate of 25° F. per hour. Samples A' and B' were final annealed in accordance with the present invention. Samples A and A' were from the same coil as were Samples B and B'.

Each of the samples were tested for permeability and core loss. The results of the tests appear hereinbelow in Table II.

TABLE II.

| Sample | Permeability (at 10 $O_e$) | Core Loss (WPP at 17KB) |
|---|---|---|
| A | 1886 | 0.716 |
| A' | 1915 | 0.689 |
| B | 1900 | 0.703 |
| B' | 1916 | 0.665 |

The benefit of the heating cycle of the present invention is clearly evident from Table II. Improvement in both permeability and core loss can be attributed thereto. The permeabilities for Samples A' and B' which were final annealed in accordance with the present invention were respectively 1915 and 1916; whereas the respective values for Samples A and B were 1886 and 1900. Samples A and B were not final annealed in accordance with the present invention. Likewise, the core loss for Samples A' and B' were respectively 0.689 and 0.665; whereas the respective values for Samples A and B were 0.716 and 0.703.

EXAMPLE II

A number of heats of silicon steel were cast and processed into silicon steel having a cube-on-edge orientation. Each of the heats had a melt chemistry within the limits of the present invention. Processing up to final texture annealing was as described for Example I. Final annealing was as described in the next paragraph.

Two samples from each heat were maintained at a temperature of 2150° F. for a period of 20 hours. One sample from each heat (Group A samples) was heated to 2150° F. at 50° F. per hour. The other sample from each heat (Group B samples) was heated to 1800° F. at 50° F. per hour, held for 10 hours and heated to 2150° F. at 50° F. per hour. Group B samples were final annealed in accordance with the present invention.

Each of the samples were tested for permeability and core loss. The average values for the Group A and Group B samples were determined. The results appear hereinbelow in Table III.

TABLE III.

| Group | Permeability (at 10 $O_e$) | Core Loss (WPP at 17KB) |
|---|---|---|
| A | 1873 | 0.723 |
| B | 1912 | 0.674 |

The benefit of the heating cycle of the present invention is clearly evident from Table III. Improvement in both permeability and core loss can be attributed thereto. The average permeability for Group B samples which were final annealed in accordance with the present invention was 1912; whereas that for Group A samples was 1873. Group A samples were not final annealed in accordance with the present invention. Likewise, the core loss for Group B samples was 0.674; whereas that for Group A samples was 0.723.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. In a process for producing electromagnetic silicon steel having a cube-on-edge orientation, which process includes the steps of: preparing a melt of silicon steel containing, by weight, from 0.02 to 0.06% carbon, from 0.015 to 0.15% manganese, from 0.005 to 0.05% of material from the group consisting of sulfur and selenium, from 0.0006 to 0.0080% boron, up to 0.0100% nitrogen, up to 1.0% copper, less than 0.005% antimony, less than 0.009% aluminum and from 2.5 to 4.0% silicon; casting said steel; hot rolling said steel; cold rolling said steel; decarburizing said steel; applying a refractory oxide coating to said steel; and final texture annealing said steel at a maximum temperature of 2300° F.; the improvement comprising the steps of final texture annealing said steel by heating it to a temperature in excess of 2000° F. and maintaining it at a temperature in excess of 2000° F. for a period of time sufficient to effect a purification of said steel, said steel being heated from a temperature of 1700° F. to a temperature of 1900° F. at an average rate of less than 30° F. per hour, so as to provide a minimum time period for the selective grain growth process to occur, said steel being maintained at a temperature in excess of 2000° F. for a period of at least 4 hours.

2. A process according to claim 1, wherein said melt has at least 0.0008% boron.

3. A process according to claim 2, wherein said steel is heated from a temperature of 1700° F. to 1900° F. at an average rate no greater than 25° F. per hour.

4. A process according to claim 2, wherein said steel is isothermally annealed within said temperature range of from 1700° to 1900° F.

5. A process according to claim 4, wherein said steel is isothermally annealed for a period of at least 6 hours.

6. A process according to claim 5, wherein said steel is isothermally annealed for a period of at least 10 hours.

7. A process according to claim 2, wherein said steel is maintained at a temperature in excess of 2000° F. for a period of at least 12 hours.

8. A process according to claim 7, wherein said steel is maintained at a temperature in excess of 2000° F. for a period of at least 20 hours.

9. A process according to claim 2, wherein said refractory oxide coating contains boron.

10. A cube-on-edge oriented silicon steel having a permeability of at least 1870(G/$O_e$) at 10 oersteds; and made in accordance with the process of claim 2.

* * * * *